US005868873A

United States Patent [19]

Brown et al.

[11] Patent Number: 5,868,873

[45] Date of Patent: Feb. 9, 1999

[54] PRE-RINSE FOR PHOSPHATING METAL SURFACES

[75] Inventors: Kevin Brown, Middlesex, United Kingdom; Gianfranco Filippo Liberti, Milan, Italy; Sarfraz Ali, Middlesex; David Thomas Gawne, Buckinghamshire, both of United Kingdom

[73] Assignee: Brent International PLC, Buckinghamshire, England

[21] Appl. No.: 602,462

[22] Filed: Feb. 16, 1996

[51] Int. Cl.[6] ..... C23C 22/78; C01B 25/37; C01B 25/45

[52] U.S. Cl. ..... 148/254; 423/306; 423/308

[58] Field of Search ..... 423/306, 308; 148/254

[56] References Cited

U.S. PATENT DOCUMENTS

| | | | |
|---|---|---|---|
| 3,510,365 | 5/1970 | Rausch et al. . | |
| 3,899,365 | 8/1975 | Guy . | |
| 4,294,808 | 10/1981 | Wasel-Nielen et al. | 423/308 |
| 4,311,536 | 1/1982 | Schapira et al. | 148/254 |
| 4,762,572 | 8/1988 | Mady et al. | 148/254 |

FOREIGN PATENT DOCUMENTS

| | | | |
|---|---|---|---|
| 0117599 | 9/1984 | European Pat. Off. . | |
| 523048 | 9/1976 | Russian Federation | 423/308 |
| 1079607 | 3/1984 | Russian Federation | 423/306 |
| 1084017 | 9/1967 | United Kingdom . | |
| 1137449 | 12/1968 | United Kingdom . | |
| 1367605 | 9/1974 | United Kingdom . | |

OTHER PUBLICATIONS

J. Klicka, Chemical Abstracts, vol. 78, No. 24, 18 Jun. 1973, p. 137.

*Primary Examiner*—Wayne Langel
*Attorney, Agent, or Firm*—Pretty, Schroeder & Poplawski

[57] ABSTRACT

Disclosed is a composition for the pre-rinsing of a metal surface prior to phosphating, a method for preparing the composition, and a method for using the composition to pre-condition the metal surface. The composition is an aqueous suspension containing a water-insoluble manganese phosphate having the formula $Mn_xX_yH_2(PO_4)_4.nH_2O$, in which X is a divalent metal ion other than manganese, x+y is 5 and x is a positive number of from 1 to 5, y is 0, 1, 2, 3 or 4, and n is less than 4.

30 Claims, No Drawings

PRE-RINSE FOR PHOSPHATING METAL SURFACES

This invention relates to forming phosphate coatings on metal surfaces and in particular to a composition for use in a pre-rinsing step in the phosphating process.

In the formation of phosphate coatings the aim is to produce a final phosphate coating which has low coating thickness of fine crystals and low surface roughness.

The application of phosphate coatings is generally by a process comprising cleaning the metal surface, rinsing, pre-rinsing (sometimes known as pre-conditioning) by contacting with a pre-rinse composition and; contacting with a phosphating solution to form the phosphate coating; rinsing; and drying the coated substrate. In the build-up of phosphate coating, the surface becomes progressively covered until the phosphate coating reaches a stage where no further change in weight occurs. This stage is known as "coating completion" and is of considerable practical importance as the practical value of a phosphate coating is maximised only when a complete coating has been achieved. (See Phosphating and Metal Pre-treatment by D. B. Freeman). Whilst not entirely understood, the pre-rinsing step is a nucleation step in which particles are provided on the surface of the substrate to initiate nucleation of phosphate crystals in a subsequent phosphating step. It is highly desirable to effect phosphating so that the coatings formed have fine crystal structure and accompanying low coating weight per unit area on the metal substrate.

It is well-known that treatment of the metal surfaces prior to contact with the phosphating solution has a significant effect on the phosphate coating formed in the phosphating step.

For example, conventionally, metal surfaces for treatment are cleaned using aqueous solutions of strongly alkaline cleaning agents and in some cases, prior to phosphating, the metal may be pickled using a strong acid such as hydrochloric or sulphuric acid. It is known that pre-treatment in either of these ways will result in a final phosphate coating mainly composed of large crystals, which is coarse and incomplete. It is also known that finely crystalline, even coatings can be obtained by phosphating after the metal surfaces for treatment have been degreased with an organic solvent for example kerosene, or treated by mechanical methods such as blasting with grit or wire particles.

For zinc phosphating processes, various ways of adapting the processes have been found to alleviate these problems, for example, rinsing the surface with aqueous solutions containing condensed phosphates, oxalic acid or titanium phosphate after alkaline cleaning or acid pickling, or rinsing the surface with alkaline permanganate is solutions.

In GB 1084017 a phosphating process is described for steel and steel sheets comprising a pre-rinsing (or initiating) step in which fine crystal nuclei of a water-insoluble phosphate of a bivalent or trivalent metal is applied to the surface of the metal prior to contact with the phosphating composition in the step. The phosphates described are zinc, calcium, magnesium, ferrous, ferric or aluminium phosphates. It is described that using this pre-rinsing, a fine, compact phosphate film is subsequently formed within a short time in the phosphating step.

However, these processes can still be improved. Manganese phosphating poses a particular problem. The methods which are useful for zinc phosphating to overcome problems due to alkaline cleaning or acid pickling are unsatisfactory in analogous manganese phosphating processes.

In GB 1137449, a pre-rinse for use in phosphating of metal substrates is also described. The process relates in particular to manganese phosphating. The pre-rinsing (or initiating) step described comprises treating the metal surface with an aqueous suspension of finely divided insoluble manganese (II) ortho-phosphate and then subjecting the treated surface to phosphatisation with a conventional acidic aqueous manganese phosphating solution. It is reported that this enables formation of a fine crystalline phosphate coating even where the metal substrate has previously been subjected to alkaline cleaning or acid pickling.

In this reference, the manganese phosphate for use in the pre-rinsing is formed as a precipitate by neutralising a solution of manganese phosphate in phosphoric acid or by adding disodium phosphate or trisodium phosphate to a solution of a manganese salt. No further details of the production of the manganese phosphate are given. In the industry, manganese phosphate precipitates for use in this type of pre-treatment are generally sold as a solid precipitate which has been dried and milled. The present inventors have found that a significantly improved final phosphate coating can be achieved if the phosphate for use in the pre-rinsing step is specially prepared.

In accordance with the present invention there is provided a method for preparing a pre-rinsing composition for phosphating metal surfaces comprising forming solid water-insoluble manganese (II) phosphate; in a heating step heating the solid at a temperature greater than 120° C., preferably greater than 150° C. to form a heated solid; and adding the heated solid to an aqueous liquid to form a suspension. The water insoluble manganese phosphate is generally formed as a precipitate in aqueous solution and then recovered as a solid.

It has been found that in accordance with the present invention it is possible to prepare phosphate coatings providing complete coverage of the surface of the metal, but with low coating weight and good surface smoothness. It has also been found that even greater improvements can be obtained by heating the manganese phosphate to even higher temperatures prior to forming the suspension. Thus, increasing the heating temperature from 120° C. upwards gives associated benefits, even at temperatures of above 300° C. or 350° C. Therefore, preferably the metal phosphate is heated at a temperature greater than 150° C., most preferably above 180° C., and even above 200° C. prior to being added to an aqueous liquid to form a suspension.

Heating may be by any conventional means but is generally by placing the solid in an oven for sufficient time and at a temperature sufficient to ensure that the solid reaches the required temperature. Generally heating will be from 5 minutes to 24 hours. Preferably it will be for at least for 10 minutes or even at least 20 minutes. The heating time is preferably no greater than 6 hours, most preferably no greater than 2 hours.

Preferably, the manganese phosphate comprises a manganese orthophosphate, preferably a manganese hureaulite.

It is not fully understood what change to the crystal structure of the manganese phosphate takes place on heating at such high temperatures which produces the beneficial effects of the present invention. However, it is thought that water of crystallisation from the phosphate is reduced below the normal levels. For example in the preferred manganese phosphate hureaulite structure, generally the formula of the phosphate crystals is $Mn_5H_2(PO_4)_4.4H_2O$. However, there is evidence to suggest that on heating at the high temperatures used for preparing the manganese phosphate heated solid for the present invention, the manganese phosphate produced has fewer than the normal number of molecules of water of crystallisation in the crystal structure. Preferably the manganese phosphate for use in the present invention is a manganese hureaulite having fewer than four molecules of water of crystallisation, based on the formula given above. Most preferably, the manganese hureaulite will have fewer than three molecules of water of crystallisation based on the formula above.

Thus the ratio of metal ions to water molecules in the manganese phosphate is preferably at least 5:3 most preferably at least 5:2.

Studies of the effect on the manganese phosphate of different heating temperatures in the heating step are reported in "Transactions of the Institute of Metal Finishing" (to be published), in an article entitled "The Effect of the Initiator Heat Treatment Temperature on the Quality of Manganese Phosphate Coatings" by S. Ali, D. T. Gawne, K. Brown and G. Liberti. It is reported that the hureaulite initiator particles used for forming an aqueous suspension retain their structure on contact with water, but that some lattice expansion of the structure results. Nevertheless, the lattice of initiators heat treated at higher temperatures (eg. 280° C.) were still in a contracted form (having, for example the d(−222) plane less than 3.152 Å) after water immersion relative to those heat treated at lower temperatures (eg. 100° C.) and substantial differences in interplanar spacings with respect to heat treatment temperature were retained.

Thus, the heat treated manganese phosphates of the present invention, on contact with water generally have interplanar expansion below 1%.

The article by Ali et al also reports that in a phosphating composition (Parker 30$^{m}$, Brent Europe Limited) the heat treated manganese phosphates show no change in interplanar spacing. It was also found that in the phosphating composition, although not in water, the heat treated manganese phosphates show a tendency to dissolve which increases with the heating temperature. In addition, in the presence of iron II ions, the iron content of the manganese phosphate initiators increased and the manganese content decreased on immersion in the phosphating solution, this tendency increasing with increasing temperature in the heating step. The relative iron and manganese contents in the phosphating compositions were seen to change in the opposite direction, compensating for the change in the manganese phosphate. It is postulated that iron substitution may play a significant role in phosphating.

The manganese phosphate may be formed in any known manner, generally by precipitation. Manganese phosphates are soluble in acid solution but are precipitated when the acidity of the solution is reduced. Therefore, the insoluble manganese (II) phosphates for use in the present invention are generally precipitated by reducing the acidity of a manganese phosphate-containing aqueous solution. Precipitates of insoluble manganese (II) phosphates may be produced for example as described in GB 1137449, by neutralising a solution of manganese phosphate in phosphoric acid to a pH over approximately pH 4 to 5, at which precipitation occurs, or by adding disodium and/or trisodium phosphate to a solution of a manganese salt.

After precipitation, the solid precipitate is recovered by any conventional means, generally by filtering or centrifugation optionally with subsequent rinsing and/or drying. The drying step may be a separate step from the heat treatment step or the precipitate may be dried in the heating step. Optionally, prior to or after the heating step, the solid precipitate recovered may be milled to break down large lumps of precipitate. Generally the particle size of at least 50% of the precipitate will be below 50 μm, preferably below 30 μm and most preferably below 5 μm.

It has been found to be particularly advantageous to co-precipitate the manganese phosphate in the presence of an additional metal ion so that some of the additional metal will be incorporated into the manganese phosphate crystal structure. For example it is known that manganese, iron hureaulite crystals can be formed in which a proportion of the manganese in the crystal structure is replaced by iron.

Therefore, preferably in the present invention, the water-insoluble manganese phosphate hureaulite has the formula $$Mn_xX_yH_2(PO_4)_4.nH_2O$$

in which x+y is 5, x and y being positive numbers between 0 and 5 and n is 4 or less, preferably no greater than 3, most preferably less than 3 and X is a divalent metal ion other than a manganese (II) ion. Thus X may be Ca, Zn, Mg, Ni, Co or Fe, but is preferably Fe. Where x is below 5, generally x is at least 2.5, preferably at least 3 and most preferably at least 4, especially where X is Fe. Where X is Fe, it has been found that particularly good results are obtained where from 5 to 15 mole % preferably around 10 mole % of the Mn in the manganese phosphate is replaced with Fe.

In order to form a manganese phosphate in which part of the manganese is replaced with an alternative metal ion, co-precipitation is carried out in which for example the acidic solution which is neutralised to form the manganese phosphate also contains a dissolved salt of the alternative metal ion.

The planar spacing of the crystals has also been monitored as a function of the heat treatment temperature of the manganese phosphate and it has been found that the planar spacing for the −222 planes decreases with increasing drying temperature. The −222 plane spacing of hureaulite is 3.152 Å (Joint Committee for Powder Defraction Standards 1984). It has been found that on heating, as described for the present invention, the value for d(−222) is below 3.152 Å. Therefore, the present invention also provides a composition for the pre-rinsing of a metal surface prior to phosphating comprising a water-insoluble manganese phosphate having planar spacing for the −222 plane below 3.152 Å, preferably below 3.147 Å.

In order to form the suspension, the heated phosphate solid is simply added to an aqueous liquid. The amount of manganese phosphate in the suspension may be between a few, for example 2 or 3 or 5 mg/l, and about 5 g/l. Higher amounts may be used but do not generally result in any further benefit. Generally, the concentration of manganese phosphate in the aqueous suspension is around 0.5 to 4 g/l, most preferably around 2 to 3 g/l. Other additives may be included in the aqueous liquid, and preferably a suspending agent is used. Particularly preferred suspending agents are condensed phosphates such as tripolyphospates and/or pyrophosphates. Generally these may be included in the suspension in amounts up to 5 g/l, preferably from 0.1 to 5 g/l. Surface active agents or insoluble salts or other phosphates may also be included for example as described in GB 1137449.

Preferably, the manganese phosphate should be well dispersed in the suspension for example by stirring.

The present invention also includes use of a suspension formed as described above as a pre-rinse liquid for a metal substrate which is to be phosphated in a subsequent metal phosphating step.

In a further aspect of the present invention, a process is provided for the formation of a phosphate coating on a metal substrate comprising obtaining solid water-insoluble manganese (II) phosphate; in a heating step, heating the solid at a temperature greater than 100° C. preferably greater than 150° C. to form a heated solid; adding the heated solid phosphate to an aqueous liquid to form a suspension; contacting the metal substrate with the suspension; and then contacting the metal substrate with a conventional phosphating solution to enable formation of a phosphate coating.

The metal substrate may be contacted with the suspension by any conventional method, for example, by immersing the metal surfaces in a bath of the suspension, or by spraying. Contact by immersion is however preferred because the particulate solids in the suspension may block spray nozzles. The temperature of contact of the metal substrate with the suspension is generally around ambient, for example from 10° to 60° C., usually from 15° to 35° C. Generally the contact time will be no greater than 1 minute. Although contact may be for longer, no additional benefit has been found to result.

Generally, immediately after having contacted the metal substrate with the suspension, even though generally still wet, the substrate is contacted with phosphating solution. However, additional steps may optionally be included in the process for example, a drying step. If desired a water rinse step may also be included, optionally in addition to a drying step. Such additional steps may be carried out between contacting the metal substrate with the suspension and contacting the metal substrate with a phosphating solution. For example, the manganese phosphate may be incorporated in a cleaning step for the metal substrate prior to phosphating, such as by incorporation in an alkaline cleaner to form a suspension. However, preferably the manganese phosphate will be in an aqueous suspension for contact with the metal substrate after the cleaning stage and most preferably in the final pre-rinse before contact of the metal substrate with the phosphating solution.

The metal substrate to be phosphated may comprise any metal on which a phosphate coating is required. Examples include zinc, aluminium, steel and their alloys.

The phosphating solution may be any conventional phosphating solution, for example a zinc, zinc/calcium, zinc/nickel/manganese or manganese phosphating solution. Most preferably the phosphating solution will be an acidic manganese phosphating solution for example as described in GB 1147399 and Electrolyte and Chemical Conversion Coatings by T. Biestek and J. Webber published by Portcullis Press 1976, p.183.

Generally, in manganese phosphating processes the phosphating step is carried out by contact with the phosphating solution at temperatures of 90° to 95° C. The use of such high temperatures is obviously undesirable because large amounts of energy are required. In the present invention, it has been found that using the specially prepared pre-rinsing suspension enables the subsequent phosphating step to be carried out at temperatures considerably lower than the conventional temperatures whilst providing phosphate coatings which have low coating weight and fine crystal structure. Therefore, preferably the subsequent phosphating step is carried out by contact with a phosphating solution at a temperature below the conventional phosphating temperature using a particular phosphating solution. In particular for manganese phosphating processes, preferably the phosphating temperature is no greater than 80° C., preferably no greater than 75° C. or even below 65° C. It appears that the suspensions of the present invention enhance the rate of nucleation of phosphate crystals so that the high temperatures used in prior art methods are not required.

The phosphating step may be carried out in accordance with any known phosphating step. For example contact of the metal substrate with the phosphating solution may be by immersion, such as in a coil-coating process, or by spraying. The contact time will be sufficient to enable a suitable phosphate coating to form.

The invention also includes a coil-coating process in which in sequence, in a first step a metal substrate is passed through a work stage in which it is contacted with the pre-rinse suspension described above and in a second step the metal substrate is passed through a work stage in which it is contacted with a phosphating solution. The coil-coating process may optionally include additional steps such as a cleaning step prior to the first step and optional rinsing and drying steps.

The phosphated metal substrates produced are suitable for post-treatments, for example coating with an organic substrate such as paint.

Examples of the present invention are as follows:

EXAMPLE 1

Solutions A, B and C were prepared each containing the components listed as follows:

| Solution A | Solution B | Solution C |
|---|---|---|
| 80 g $Na_2HPO_4$<br>67 g $NaH_2PO_4$<br>2 liters demineralised water.<br>pH ≈ 7 | 240 g $MnSO_4.H_2O$<br>1 liter demineralised water.<br>pH ≈ 2 (adjusted with $H_2SO_4$ 20%) | NaOH 20% by weight in demineralised water. |

Solution A was then heated at the desired temperature (see below) and the temperature was kept constant by placing the solution in a thermostatic water bath. Solution B was then added dropwise, under constant stirring over a time period of either approximately one hour or approximately four hours. The pH was maintained between 6.2 and 6.7 during precipitation, by dropwise addition of solution C.

The precipitate was collected by filtering, rinsing with demineralised water and oven drying at pre-selected temperatures of either 100° C., 180° C. or 270° C. Chemical analysis and x-ray diffraction showed a composition corresponding closely to manganese hureaulite, $Mn_5H_2(PO_4)_4.4H_2O$.

The precipitating conditions for the various samples are outlined in Table 1 below:

| Manganese Phosphate Sample | Precipitation Temperature (°C.) | Time of addition of solution B (hrs) | Oven Drying Temperature (°C.) |
|---|---|---|---|
| 1 | 50 | 1 | 100 |
| 2 | 70 | 1 | 100 |
| 3 | 90 | 1 | 100 |
| 4 | 50 | 4 | 100 |
| 5 | 70 | 4 | 100 |
| 6 | 90 | 4 | 100 |
| 7 | 50 | 1 | 180 |
| 8 | 70 | 1 | 180 |
| 9 | 90 | 1 | 180 |
| 10 | 50 | 4 | 180 |
| 11 | 70 | 4 | 180 |
| 12 | 90 | 4 | 180 |
| 13 | 70 | 1 | 270 |

EXAMPLE 2

Phosphating Procedure and Results

Mild steel panels 152 mm×102 mm (6"×4") having a thickness 0.9 mm (CR4 grade "Gold Seal" [trademark]

panels) were obtained and subjected to a phosphating sequence including pre-treatment using pre-rinsing solutions comprising 3 g/l of manganese phosphate samples suspended in demineralised water.

The phosphating solution used was a "Parker 30" (trademark) acidic manganese phosphating solution at a concentration of 8.4% (30 points) which had been aged with steel wool to produce an iron concentration of approximately 1 g/l. The phosphating solution was held at 90° to 95° C. throughout the phosphating.

The treatment sequence was as follows:

1) Cleaning in "Pyroclean 630" (Trademark), medium alkalinity silicated cleaner at a concentration of 2.5% by weight in water at 70° C., by immersion for 10 minutes.
2) Water rinse with cold water.
3) Pickle by immersion in a 50 g/l solution of citric acid for 5 minutes at room temperature.
4) Water rinse with cold water.
5) Pre-rinse at room temperature by immersion in a pre-rinsing solution for 1 minute.
6) Phosphate by immersion in the phosphating solution for 15 minutes.
7) Water rinse.
8) Air blast.
9) Oven dry at 80° C. for 10 minutes.

The coating weight of the various samples was evaluated by weighing the coated panel, stripping the coating in a 5% by weight $CrO_3$ solution at 70° C. for 15 minutes, reweighing the panel and calculating the weight loss. The coating appearance (crystal size) was evaluated by a scanning electron microscope at magnification ×1000. The results are given in Table 2 below.

TABLE 2

| Manganese Phosphate Sample in Pre-Rinsing solution | Coating Weight ($g/m^2$) | Appearance |
|---|---|---|
| 1 | | |
| 2 | | |
| 3 | 25–32 | rough, coarse crystals |
| 4 | | |
| 5 | | |
| 6 | | |
| 7 | | |
| 8 | | |
| 9 | 15–21 | refined crystals |
| 10 | | |
| 11 | | |
| 12 | | |
| 13 | 12–16 | refined crystals |

As can be seen, neither the precipitation temperature nor the time of addition of solution B in the formation of the manganese phosphate sample affects the phosphate coating significantly. However, the rough coarse crystals obtained using samples 1 to 6 showed only a slight improvement when compared with non-activated samples (i.e. test samples which had had no pre-rinse activation step). The significant advantage obtained when the manganese phosphate sample was heated at higher temperatures is clear from a comparison of for example, samples 2, 8 and 13.

EXAMPLE 3

Heat Treatment of a Commercial Manganese Phosphate Activator

It was decided to compare the results obtained with a sample of a commercially available manganese phosphate activator ("Parcolene VMA") both under the normal operating instructions, and having been heated. In addition, the temperature of phosphating was varied.

Phosphating was carried out as described and in the order set out below:

1) Cleaning: as in Step 1 of Example 2
2) Water rinse.
3) Pre-rinse: using a solution comprising 3 g/l "Parcolene VMA" (trademark) activator+3 g/l sodium tripolyphosphate in demineralised water.
4) Phosphating: as in example 2, at 70° or 90° C.
5) Water rinse.
6) Air blast.
7) Oven dry.

The results are given below for tests using sample 14 (Parcolene VMA under normal operating instructions) and sample 15 (Parcolene VMA which was heated in an oven at 300° C. for two hours prior to forming the suspension).

TABLE 3

| Sample | Phosphating temperature (°C.) | Coating weight ($g/m^2$) | Appearance of crystals |
|---|---|---|---|
| No pre-rinse | | — | Few large crystals |
| 14 | 70° C. | 12–15 | coarse |
| 14 | 90° C. | 14–16 | refined |
| 15 | 70° C. | 8–10 | refined |
| 15 | 90° C. | 8–10 | refined |

It can clearly be seen that the heat treatment in accordance with the present invention provides significant benefits in reducing the coating weight and producing fine crystal in a smooth phosphate coating. In particular, the present invention enables the phosphating step to be carried out at significantly lower temperatures than is conventional whilst still providing improved results.

EXAMPLE 4

Characterising the Crystals Obtained by Heat Treatment

The manganese hureaulite obtained as described in Examples 1 and 2 was investigated to determine any structural changes on heating at increasing temperatures.

A) Powder colour

The starting powder being whitish to pink, after stoving at 300° C. it darkens, showing a brown colour.

A water suspension of the heat treated material also becomes darker, the colour shift being from pink (up to about 150° C.) to brown (300° C.).

B) Water Loss

The water content of manganese hureaulite is approximately 10%. On heating, part of the crystallisation water is lost. The thermogravimetric behaviour of the commercial Parcolene VMA is as follows in Table 4.

TABLE 4

| Heat Treatment | | |
|---|---|---|
| Temperature (°C.) | Time (hrs) | Weight Loss % |
| 150 | 1 h | ≈1.3% |
| 200 | 1 h | ≈3.4% |
| 250 | 1 h | ≈4.6% |
| 300 | 1 h | ≈5.7% |
| 300 | 2 h | ≈7.0% |

The laboratory precipitated hureaulite, when heated to 350° C. shows a weight loss inversely proportional to the drying temperature, shown in Table 5.

TABLE 5

| Drying Temperature | Weight loss at 350° |
|---|---|
| 100 | 10% |
| 180 | 7.5% |
| 250 | 4.5% |
| 300 | 3.5% |

D) Planar spacing

The planar spacing of the crystals has been measured as a function of the heat treatment, for the planes −222 that give a very clear x-ray diffraction peak. A decrease in the planar spacing for the −222 planes with increasing drying temperature was evident from the results which are given in Table 6.

TABLE 6

| Heat Treatment Temperature (°C.) | d (−222) Å |
|---|---|
| 100° | 3.152Å |
| 160° | 3.147 |
| 280° | 3.139 |
| 300° | 3.135 |
| hureaulite* | 3.152 |
| Parcolene VMA | 3.155 |

*The value for hureaulite has been taken from JCPDS (Joint Committee for Powder Diffraction Standards) 1984 card.

EXAMPLE 5

A further example was carried out to illustrate the benefit of incorporating an additional metal ion with manganese in the phosphate structure.

Coprecipitation of iron (II) together with manganese has been attempted as a way to further improve activity of the pre-rinse.

The precipitation procedure was carried out as in Example 1, except that solution B was prepared by mixing $MnSo_4.H_2O$ and $FeSO_4.7H_2O$ in different amounts, so to have ratios of Mn:Fe (in moles) ranging from pure Mn to pure Fe II. In addition, the precipitation, filtration, rinse and heat treatment were conducted under nitrogen, to avoid oxidation of Fe II to Fe III.

Phosphating was carried out as described in example 2. The results are given in table 7 below.

TABLE 7

| Ratio Mn:Fe II | Coating weight |
|---|---|
| no pre-rinse | 25–26 g/m |
| 100:0 | 18–20 g/m |
| 97.5:2.5 | 20–21 g/m |
| 90:10 | 15–16 g/m |
| 65:35 | 18–19 g/m |
| 35:65 | 26–28 g/m |
| 0:100 | 26–27 g/m |

The results clearly showing the positive effect of the inclusion of Fe II in the hureaulite precipitate, with a maximum benefit being obtained at a ratio of Mn:Fe of around 90:10.

We claim:

1. A method for preparing a pre-rinsing composition for phosphating metal surfaces including the steps of:

forming solid water-insoluble manganese (II) phosphate; heating the solid at a temperature greater than 120° C. to form a heated solid; and adding the heated solid to an aqueous liquid to form a suspension.

2. A method according to claim 1 in which the manganese phosphate before the heating step has the formula:

$$Mn_xX_yH_2(PO_4)_4.nH_2O$$

in which X is a divalent metal ion other than manganese, x+y is 5 and x is a positive number of from 1 to 5, y is 0, 1, 2, 3 or 4, and n is 4.

3. A method according to claim 2 in which the water-insoluble manganese (II) phosphate is formed by neutralization of an acidic solution containing manganese phosphate and a salt of the divalent metal ion X in solution, to precipitate the said manganese phosphate.

4. A method according to claim 2 in which X is iron.

5. A method according to claim 2 wherein y is other than 0.

6. A method according to claim 2 wherein y is at least 2.5.

7. A method according to claim 1 in which the phosphate comprises a manganese orthophosphate.

8. A method according to claim 7 wherein the manganese orthophosphate is manganese hureaulite.

9. A method according to claim 1 in which in the heating step, the phosphate is heated at a temperature greater than 200° C.

10. A method according to claim 9 wherein the phosphate is heated at a temperature greater than 250° C.

11. A method according to claim 1 in which the suspension additionally comprises a suspending agent.

12. A method according to claim 11 wherein the suspending agent is a condensed phosphate.

13. A process for the formation of a phosphate coating on a metal substrate including the steps of: forming solid water-insoluble manganese (II) phosphate; heating the solid at a temperature greater than 120° C. to form a heated solid; adding the heated solid phosphate to an aqueous liquid to form a suspension; contacting the metal substrate with the suspension; and then contacting the metal substrate with a phosphating solution for sufficient time to permit formation of a phosphate coating.

14. A process according to claim 13 in which the metal substrate is contacted with a phosphating solution at a temperature of no greater than 80° C.

15. A process according to claim 13 in which the phosphating solution is an aqueous acidic manganese phosphating solution.

16. A process according to claim 13 wherein the solid is heated at a temperature greater than 150° C.

17. A process according to claim 13 in which the metal substrate is contacted with a phosphating solution at a temperature of no greater than 75° C.

18. A process according to claim 13 wherein the manganese phosphate has the formula $$Mn_xX_yH_2(PO_4)_4.nH_2O$$

in which X is a divalent metal ion other than manganese, x+y is 5 and x is a positive number of from 1 to 5, y is 0, 1, 2, 3 or 4, and n is less than 4.

19. A process according to claim 18 wherein y is other than 0.

20. A process according to claim 18 wherein n is less than 3.

21. A composition for the pre-rinsing of metal surfaces prior to phosphating, comprising an aqueous suspension of a water-insoluble manganese phosphate having the formula $$Mn_xX_yH_2(PO_4)_4.nH_2O$$

in which X is a divalent metal ion other than manganese, x+y is 5 and x is a positive number of from 1 to 5, y is 0, 1, 2, 3 or 4, and n is less than 4.

22. A composition according to claim 21 wherein y is other than 0.

23. A composition according to claim 21 wherein n is less than 3.

24. A composition according to claim 21 wherein the planar spacing for the −222 plane is below 3.152 A units.

25. A composition according to claim 21 wherein the planar spacing for the −222 plane is below 3.147 A units.

26. A composition for the pre-rinsing of a metal surface prior to phosphating comprising an aqueous suspension of a water-insoluble manganese phosphate having planar spacing for the −222 plane below 3.152 A units.

27. A composition according to claim 26 wherein the planar spacing for the −222 plane is below 3.147 A units.

28. A process for preconditioning a metal surface prior to forming a phosphate coating on the surface comprising the step of contacting the metal surface with an aqueous suspension of a water-insoluble manganese phosphate having the formula $$Mn_xX_yH_2(PO_4)_4.nH_2O$$

in which X is a divalent metal ion other than manganese, x+y is 5 and x is a positive number of from 1 to 5, y is 0, 1, 2, 3 or 4, and n is less than 4.

29. A process for pre-conditioning a metal surface prior to forming a phosphate coating on the surface comprising the step of contacting the metal surface with an aqueous suspension of a water-insoluble manganese phosphate having planar spacing for the −222 plane below 3.152 Å units.

30. A process for treating a metal surface comprising the steps of pre-rinsing a metal surface with an aqueous suspension of a water-insoluble manganese phosphate having the formula $$Mn_xX_yH_2(PO_4)_4.nH_2O$$

in which X is a divalent metal ion other than manganese, x+y is 5 and x is a positive number of from 1 to 5, y is 0, 1, 2, 3 or 4 and n is less than 4, then contacting the pre-rinsed metal surface with a phosphating solution.

* * * * *

UNITED STATES PATENT AND TRADEMARK OFFICE

CERTIFICATE OF CORRECTION

PATENT NO. : 5,868,873

DATED : February 9, 1999

INVENTOR(S) : Kevin Brown et al.

It is certified that error appears in the above-identified patent and that said Letters Patent is hereby corrected as shown below:

On the title page, at column [22], before "Filed", insert –PCT–

On the title page, at column [22], delete "Feb. 16, 1996", and insert –Sep. 12, 1994–

On the title page, insert –[86] PCT No.: PCT/GB94/01982
371 Date: Feb. 16, 1996
102(e) Date: Feb. 16, 1996–

On the title page, insert –[87] PCT Pub. No.: W095/08007
PCT Pub. Date: March 23, 1995–

On the title page, insert –[30] Foreign Application Priority Data
Sep. 17, 1993 [GB] United Kingdom .....9319317.5

Signed and Sealed this

Seventh Day of March, 2000

*Attest:*

*Attesting Officer*

Q. TODD DICKINSON

*Commissioner of Patents and Trademarks*